US010036995B2

(12) United States Patent
Aizawa et al.

(10) Patent No.: US 10,036,995 B2
(45) Date of Patent: Jul. 31, 2018

(54) DETACHABLE DEVICE FOR IMAGE FORMING APPARATUS AND IMAGE FORMING APPARATUS

(71) Applicant: FUJI XEROX CO., LTD., Tokyo (JP)

(72) Inventors: Shinichi Aizawa, Ebina (JP); Masakatsu Eda, Ebina (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/248,854

(22) Filed: Aug. 26, 2016

(65) Prior Publication Data

US 2017/0261914 A1 Sep. 14, 2017

(30) Foreign Application Priority Data

Mar. 8, 2016 (JP) ..... 2016-044847

(51) Int. Cl.
*G03G 15/00* (2006.01)
*G03G 21/16* (2006.01)

(52) U.S. Cl.
CPC ..... *G03G 21/1647* (2013.01); *G03G 15/6576* (2013.01)

(58) Field of Classification Search
CPC ..... G03G 2215/00704; G03G 15/6576; G03G 21/1647; G03G 21/1633; G07D 11/003
USPC ..... 399/110, 124
See application file for complete search history.

(56) References Cited

U.S. PATENT DOCUMENTS 8,971,762 B2 * 3/2015 Fukase ..... G03G 15/16 399/121
9,075,386 B2 * 7/2015 Uchida ..... G03G 21/1633

FOREIGN PATENT DOCUMENTS

JP 2003-300643 A 10/2003
JP 2006-154604 A 6/2006

* cited by examiner

*Primary Examiner* — Walter L Lindsay, Jr.
*Assistant Examiner* — Ruth Labombard
(74) *Attorney, Agent, or Firm* — Oliff PLC

(57) ABSTRACT

A detachable device includes: a detachable member that is provided to be attachable to and detachable from an apparatus main body in which a first rotating member is provided and that includes a second rotating member which is brought into press-contact with the first rotating member; a moving member that is provided in the apparatus main body, that holds the detachable member at an attachment position to the apparatus main body so as to maintain a press-contact load between the first rotating member and the second rotating member, and that is movable to a position at which the detachable member is not held by the moving member; and a release member as defined herein.

9 Claims, 7 Drawing Sheets

DETACHABLE DEVICE FOR IMAGE FORMING APPARATUS AND IMAGE FORMING APPARATUS

CROSS-REFERENCE TO RELATED APPLICATIONS

This application is based on and claims priority under 35 USC 119 from Japanese Patent Application No. 2016-044847 filed Mar. 8, 2016.

BACKGROUND

Technical Field

The present invention relates to a detachable device and an image forming apparatus.

SUMMARY

According to an aspect of the invention, there is provided a detachable device including: a detachable member that is provided to be attachable to and detachable from an apparatus main body in which a first rotating member is provided and that has a second rotating member which is brought into press-contact with the first rotating member; a moving member that is provided in the apparatus main body, that holds the detachable member at an attachment position to the apparatus main body so as to maintain a press-contact load between the first rotating member and the second rotating member, and that is movable to a position at which the detachable member is not held by the moving member; and a release member that is provided in the detachable member, and that causes the moving member to move to the position at which the detachable member is not held by the moving member in response to a detachment operation of the detachable member from the apparatus main body such that the first rotating member and the second rotating member are released from the press-contact therebetween.

BRIEF DESCRIPTION OF THE DRAWINGS

Exemplary embodiments of the present invention will be described in detail based on the following figures, wherein.

DETAILED DESCRIPTION

Hereinafter, exemplary embodiments of a detachable device and an image forming apparatus of the invention will be described with reference to the figures. Note that, in the figures, a direction indicated by arrow H means an apparatus-height direction and a direction indicated by arrow W means an apparatus-width direction.

Overall Configuration of Image Forming Apparatus

Figure 1:
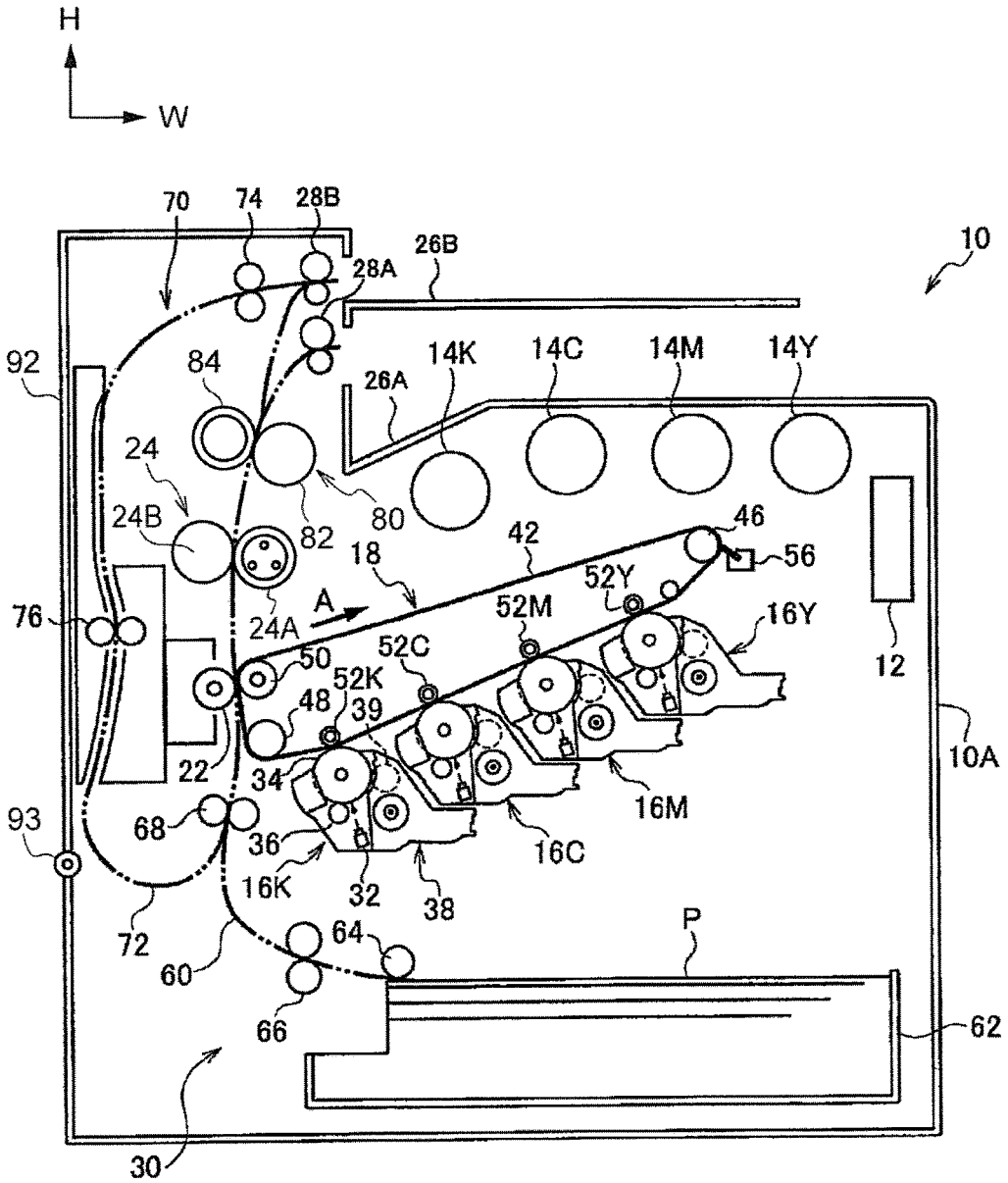
FIG. 1 is a diagram illustrating a configuration of an image forming apparatus according to an exemplary embodiment of the invention.

FIG. 1 illustrates an example of a configuration of an image forming apparatus including a detachable device as an exemplary embodiment of the invention. Note that, hereinafter, Y represents yellow, M represents magenta, C represents cyan, and K represents black, and, the description is provided with color reference signs (Y, M, C, and K) corresponding to the colors assigned after ends of reference signs, in a case where there is a need to distinguish between the components and toner images by colors thereof. Hereinafter, in a case where the components and the toner images are not distinguished but are collectively described, the color reference signs after the tail of reference signs are omitted.

As illustrated in FIG. 1, an image forming apparatus 10 includes, inside an apparatus main body 10A, an image processing portion 12 that performs image processing, and image forming units 16 that form toner images having the respective colors. The image forming units 16 are arranged at intervals in a direction inclined with respect to a horizontal direction. A primary transfer unit 18, to which transferring of the toner images formed in the color image forming units 16 is multiplied, is provided above the color image forming units 16.

A secondary transfer roll 22, which transfers, to a sheet P, the toner images transferred to the primary transfer unit 18 in a multiplying manner, performs multiple transferring of the toner image, is provided on a side (left side in FIG. 1) of the primary transfer unit 18. The sheet P is an example of a recording medium transported along a transporting path 60 by a supply-transport unit 30 to be described below.

A fixing device 24 is provided on the downstream side of the secondary transfer roll 22 in the transport direction of the sheet P so as to fix, to the sheet P, the toner image transferred to the sheet P by heat and pressure. In addition, a curl removing device (straightening device) 80 is provided on the downstream side of the fixing device 24 in the transporting direction of the sheet P so as to removes a curl of the sheet P with the sheet P transported while being nipped and pressurized.

In addition, an exit roll 28A and an exit roll 28B are provided on the downstream side of the curl removing device 80 in the transporting direction of the sheet P. The exit roll 28A causes the sheet P to exit to an exit portion 26A provided in an upper portion of the apparatus main body 10A and the exit roll 28B causes the sheet P to exit to an exit portion 26B provided above the exit portion 26A.

The supply-transport unit 30 that supplies and transports the sheet P is provided below on a side of the image forming units 16. In addition, four toner cartridges 14 (14K to 14Y) for the respective colors, which are filled with toner that is supplied to a developing device 38 to be described below, are arranged below the primary transfer unit 18 side by side in the apparatus-width direction.

The color image forming units 16 are all configured to be the same except for a color of toner, and each is configured to include a rotating circular columnar image holding member 34, a charging device 36 that charges a surface of the image holding member 34, and an exposure device 32 that irradiates the charged surface of the image holding member 34 with exposure light that forms an electrostatic latent image. In addition, the image forming unit 16 includes the developing device 38 that develops, with developer, the electrostatic latent image formed by the irradiation with the exposure light by the exposure device 32. In addition, the image forming unit 16 includes a cleaning blade (not illustrated) that cleans the surface of the image holding member 34.

A developing roll 39 is disposed to face the image holding member 34 in the developing device 38, and the developing device 38 develops, with developer using the developing roll 39, the electrostatic latent image formed on the image holding member 34 such that the electrostatic latent image is visualized as a toner image.

The primary transfer unit 18 includes an endless intermediate transfer belt 42, a drive roll 46 around which the intermediate transfer belt 42 is looped, a tension applying roll 48, and an assist roll 50. The drive roll 46 causes the intermediate transfer belt 42 to loop in a direction of arrow A, and the tension applying roll 48 applies tension to the intermediate transfer belt 42. In addition, the primary transfer unit 18 has primary transfer rolls 52 disposed on a side opposite to the image holding members 34 of the colors with the intermediate transfer belt 42 interposed therebetween. Further, a cleaning blade 56 is disposed on a side opposite to the drive roll 46 with the intermediate transfer belt 42 interposed therebetween so as to contact with the surface of the intermediate transfer belt 42 and to clean the surface of the intermediate transfer belt 42.

In addition, the secondary transfer roll 22 is provided on a side opposite to the assist roll 50 with the intermediate transfer belt 42 interposed therebetween so as to transfer, to a sheet P that is transported, the toner image transferred on the intermediate transfer belt 42. The secondary transfer roll 22 is grounded, the assist roll 50 forms an opposite electrode of the secondary transfer roll 22, and, when a secondary transfer voltage is applied to the assist roll 50, the toner image is transferred to the sheet P.

The supply-transport unit 30 is disposed below in a perpendicular direction from the image forming units 16 in the apparatus main body 10A and includes a sheet feeding member 62 in which plural sheets P are stacked. Further, the supply-transport unit 30 includes a sheet feeding roll 64 that feeds, in a transporting path 60, the sheets P stacked in the sheet feeding member 62, a separation roll 66 that separates, one by one, the sheet P fed by the sheet feeding roll 64, and a position adjusting roll 68 that adjusts a transport timing of the sheet P.

The fixing device 24 includes an endless heating belt 24A and a pressure roll 24B that is driven to rotate. The heating belt 24A is driven to rotate in response to the rotation of the pressure roll 24B and rotates. The sheet P'transported to the fixing device 24 is heated by the heating belt 24A and is pressurized by the heating belt 24A and the pressure roll 24B, and the toner image is fixed on a surface (image formed surface) of the sheet P on a side.

The curl removing device 80 includes an endless straightening belt 82 as an example of the first rotating member and a straightening roll 84 as an example of the second rotating member. In addition, the straightening roll 84 is driven to rotate by a motor (not illustrated) and the straightening belt 82 is driven to rotate in response to the rotation of the straightening roll 84. The sheet P transported to the curl removing device 80 is pressurized by the straightening belt 82 and the straightening roll 84 and is transported, and then a curl of the sheet P is straightened and removed.

Further, the supply-transport unit 30 includes a duplex-printing transport device 70 used when the sheet P having a toner image fixed to one surface thereof does not exit to the exit portion 26B by the exit roll 28B, but a toner image is formed on the other surface of the sheet. The duplex-printing transport device 70 includes a duplex-printing transport path 72 in which the front and back surfaces of the sheet P is reversed and the sheet P is transported toward the position adjusting roll 68 from the exit roll 28B, and a transport roller 74 and a transport roller 76 which transport the sheet P along the duplex-printing transport path 72.

In the image forming apparatus 10, tone data for the respective colors are sequentially output from the image forming portion 12 to the exposure devices 32 of the corresponding colors, and the charged front surface of the image holding member 34 by the charging device 36 is irradiated with the exposure light emitted from the exposure device 32. In this manner, an electrostatic latent image is formed on the front surface of the image holding member 34. The electrostatic latent images formed on the image holding members 34 are developed by the developing devices 38 of the colors and are visualized as toner images of the colors of Y, M, C, and K. Further, the color toner images formed on the image holding members 34 are transferred on the looping intermediate transfer belt 42 in a multiplying manner by the primary transfer rolls 52 of the primary transfer unit 18.

The color toner images transferred on the intermediate transfer belt 42 in the multiplying manner are secondarily transferred at a secondary transfer position by the secondary transfer roll 22 to the sheet P transported from the sheet feeding member 62 along the transporting path 60 by the sheet feeding roll 64, the separation roll 66, and the position adjusting roll 68.

In addition, the sheet P to which the toner image is transferred is transported to the fixing device 24 and the toner image is fixed on the sheet P by the fixing device 24. The sheet P, on which the toner image is fixed, is straightened and a curl of the sheet P is removed by the curl removing device 80. Further, the sheet P, of which the curl is straightened, exits to the exit portion 26A by the exit roll 28A or exits to the exit portion 26B by the exit roll 28B.

Configuration of Detachable Device

Figure 2:
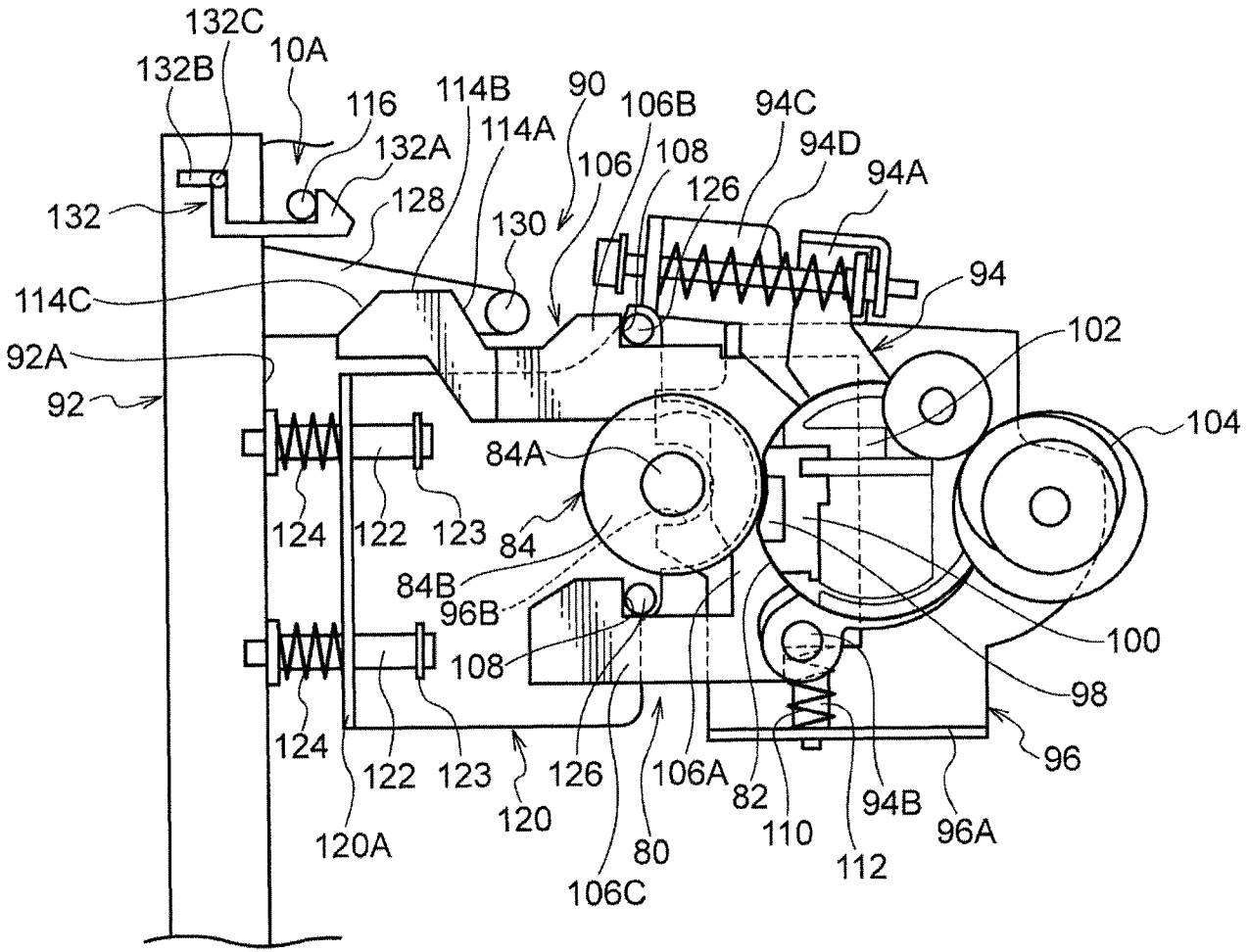
FIG. 2 is a diagram illustrating a configuration of a detachable device according to an exemplary embodiment that is used in the image forming apparatus illustrated in FIG. 1 and illustrating a state in which a cover is attached to an apparatus main body.

Next, a detachable device, which is applied to the curl removing device 80 of the exemplary embodiment will be described. FIG. 2 illustrates a state in which the cover 92 that is used in a detachable device 90 is attached to the apparatus main body 10A. In addition, FIG. 4 illustrates a state shown during detachment of the cover 92 that is used in the detachable device 90 from the apparatus main body 10A. As illustrated in FIGS. 2 and 4, the detachable device 90 includes the cover 92 as an example of the detachable member provided to be attachable to and detachable from the apparatus main body 10A of the image forming apparatus 10. The cover 92 is configured to have an upper side that rotates in the apparatus-width direction around a hinge 93 (refer to FIG. 1) provided on a lower side of the apparatus main body 10A. Note that, in FIGS. 2 to 7, the cover 92 actually rotates with respect to the apparatus main body 10A; however, the cover rotates at a small rotational angle and thus, is illustrated approximately in a straight line.

In the apparatus main body 10A, the straightening belt 82 is provided as an example of the first rotating member described above disposed in the curl removing device 80. In the cover 92, the straightening roll 84 is provided as an example of the second rotating member described above disposed in the curl removing device 80. The straightening belt 82 and the straightening roll 84 are disposed side by side in the apparatus-width direction (direction of the arrow W). In the state in which the cover 92 is attached to the apparatus main body 10A (the state of closing by the cover 92), the straightening roll 84 is brought into press-contact with the straightening belt 82 (refer to FIG. 2).

The curl removing device 80 includes a support unit 94 that supports the straightening belt 82 in a rotatable (moving in a loop) manner, and a holding member 96 that holds the support unit 94. The support unit 94 and the holding member 96 are disposed inside the apparatus main body 10A and the holding member 96 is mounted to the apparatus main body 10A by a mounting jig (not illustrated).

The straightening belt 82 is configured of a thin cylindrical member made of a synthetic resin such as a polyimide resin or a polyamide resin. Inside the straightening belt 82, a pad 98 that presses the straightening belt 82 to the straightening roll 84 and a holding portion 100 that holds the pad 98 are provided. Further, inside the straightening belt 82, a support portion 102, which supports the straightening belt 82 in a rotatable manner, is provided.

The support unit 94 has a parent lever 94A and a child lever 94C that rotates with respect to the parent lever 94A around a shaft 94B disposed below the parent lever 94A. A spring 94D, which biases the child lever 94C toward the straightening roll 84, is provided in the parent lever 94A. The holding portion 100 and the support portion 102 are, as an example, attached to the child lever 94C, and the straightening belt 82 presses the straightening roll 84 by a force of the spring 94D. In addition, a cam 104 is rotatably supported by the holding member 96 and the parent lever 94A is configured to move to a side of approaching or separation from the straightening belt 82 due to the rotation of the cam 104. The cam 104 is driven to rotate by a motor (not illustrated). In addition, the child lever 94C is biased to the straightening roll 84 side by the spring 94D with respect to the parent lever 94A, and thereby, the straightening belt 82 supported by the child lever 94C may move in an approaching direction in which the straightening belt approaches the straightening roll 84 and in a separation direction in which the straightening belt is separated from the straightening roll 84. Note that a configuration of the support unit 94 is not limited to the exemplary embodiment and it is possible to appropriately modify the configuration.

The curl removing device 80 adjusts an amount of movement and a movement direction of the straightening belt 82 by the support unit 94, thereby adjusting nip pressure (press-contact load) with which the sheet P is nipped between the straightening belt 82 and the straightening roll 84. In addition, the curl removing device 80 adjusts the nip pressure, thereby adjusting a contact area (amount of nip) between the sheet P and the nip portion when the sheet P is nipped at the nip portion between the straightening belt 82 and the straightening roll 84. By the configuration described above, the curl removing device 80 adjusts the nip pressure and the amount of the nip, thereby adjusting an amount of straightening and a straightening direction of the sheet P. The sheet P transported to the curl removing device 80 is pressurized and transported to the nip portion between the straightening belt 82 and the straightening roll 84, and, as a result, the curl of the sheet P is removed and straightened.

The detachable device 90 includes a moving member 106 disposed to be movable in a vertical direction with respect to the holding member 96. The moving member 106 is movable in the vertical direction along a guide portion (not illustrated) provided in the holding member 96 in the vertical direction. The moving member 106 is configured to move in a direction intersecting with the attachment-detachment direction (apparatus-width direction indicated by arrow W) of the cover 92 with respect to the apparatus main body 10A. In the exemplary embodiment, the moving member 106 moves in a direction orthogonal to the attachment-detachment direction (apparatus-width direction indicated by arrow W) of the cover 92 with respect to the apparatus main body 10A. In other words, the moving member 106 moves in a direction orthogonal to a direction in which a press-contact load between the straightening belt 82 and the straightening roll 84 acts. The moving member 106 is formed to have a U shape in a front view of the detachable device 90. More specifically, the moving member 106 includes a longitudinal wall 106A disposed in the vertical direction at a position at which the moving member 106 overlaps the holding member 96 in the front view of the detachable device 90, an upper hook 106B extending from the upper portion of the longitudinal wall 106A in the vertical direction to the cover 92 side, and a lower hook 106C extending from the lower portion of the longitudinal wall 106A in the vertical direction to the cover 92 side. A length of the upper hook 106B in a longitudinal direction thereof is longer than a length of the lower hook 106C in the longitudinal direction in the front view of the detachable device 90.

A recess 108 is provided in an upper wall portion in an intermediate portion of the upper hook 106B in the longitudinal direction so as to be recessed to the lower side in the vertical direction and to engage with an upper pin 126 to be described below, which is provided in the cover 92. In addition, a recess 108 is provided in an upper wall portion in an intermediate portion of the lower hook 106C in the longitudinal direction so as to be recessed to the lower side in the vertical direction and to engage with a lower pin 126 to be described below, which is provided in the cover 92. A projecting portion 112 disposed to project upward is provided in a lower wall 96A of the holding member 96. A spring 110 is provided around the projecting portion 112 and is an example of a bias member that biases the moving member 106 to an upper position, at which the moving member hold the cover 92. In a state in which the moving member 106 moves upward by a force of the spring 110 with respect to the holding member 96, the upper pin 126 of the cover 92 engages with the recess 108 of the upper hook 106B, and the lower pin 126 of the cover 92 engages with the recess 108 of the lower hook 106C (refer to FIG. 2). In this manner, the moving member 106 holds the cover 92 at an attachment position to the apparatus main body 10A, and thereby the press-contact load is maintained between the straightening belt 82 and the straightening roll 84.

In addition, the moving member 106 is configured to move downward against the force of the spring 110 and thereby to move to a position at which the moving member does not hold the cover 92. In other words, in a state in which the moving member 106 moves downward, the recess 108 of the upper hook 106B is disengaged from the upper pin 126 of the cover 92, and the recess 108 of the lower hook 106C is disengaged from the lower pin 126 of the cover 92 (refer to FIG. 4).

A support member 120, which supports the straightening roll 84 in a rotatable manner, is provided in the cover 92. More specifically, the straightening roll 84 includes a shaft 84A and an outer peripheral portion 84B provided around the shaft 84A, and the shaft 84A of the straightening roll 84 is rotatably supported by the support member 120. The shaft 84A of the straightening roll 84 is driven to rotate by a motor (not illustrated). The straightening roll 84 rotates in a direction in which the sheet P at the contact portion between the straightening roll and the straightening belt 82 is sent from the lower side to the upper side in the vertical direction (refer to FIG. 1). A U-shaped recessed portion 96B is provided in the holding member 96 of the apparatus main body 10A. The shaft 84A is inserted into the recessed portion 96B in the state in which the cover 92 is attached to the apparatus main body 10A.

The cover 92 is provided with plural float pins 122 that are disposed in the apparatus-width direction (direction of arrow W) and support the support member 120 in a movable manner. The plural float pins 122 are fixed to an inner wall 92A of the cover 92 on the apparatus main body 10A side. A wall 120A facing the cover 92 is provided in the support member 120 and the float pins 122 penetrates through holes (not illustrated) provided in the wall 120A. In addition, a float spring 124 is provided between the cover 92 and the support member 120. The float spring 124 is provided around the float pin 122 and biases the support member 120 to the holding member 96 side. A stopper 123 is provided at the front end of the float pin 122 and has an outer diameter larger than an inner diameter of the hole (not illustrated) of the wall 120A.

The support member 120 may move along the float pin 122 in the apparatus-width direction (direction of arrow W). The float spring 124 is configured to cause the support member 120 to move to a position at which the wall 120A of the support member 120 contacts with the stopper 123 in a free state (refer to FIGS. 4 and 5). In other words, in the state in which the cover 92 is detached from the apparatus main body 10A (state of opening by the cover 92), the support member 120 is caused to move to the position, at which the wall 120A of the support member 120 contacts with the stopper 123, by a force of the float spring 124. Meanwhile, in the state in which the cover 92 is attached to the apparatus main body 10A (state of closing by the cover 92), the straightening roll 84 contacts with the straightening belt 82, the float spring 124 is compressed, and thereby the support member 120 moves along the float pin 122 to a side on which the support member approaches the cover 92 (refer to FIG. 2).

The pin 126 is provided in the support member 120 above the straightening roll 84 and is an example of an engagement portion, which engages with the recess 108 of the upper hook 106B in the moving member 106. The pin 126 is provided in the support member 120 below the straightening roll 84 and is an example of an engagement portion, which engages with the recess 108 of the lower hook 106C in the moving member 106. The support member 120 is configured to be held in the moving member 106 with the upper pin 126 engaging with the recess 108 of the upper hook 106B and with the lower pin 126 of the support member 120 engaging with the recess 108 of the lower hook 106C.

Figure 3:
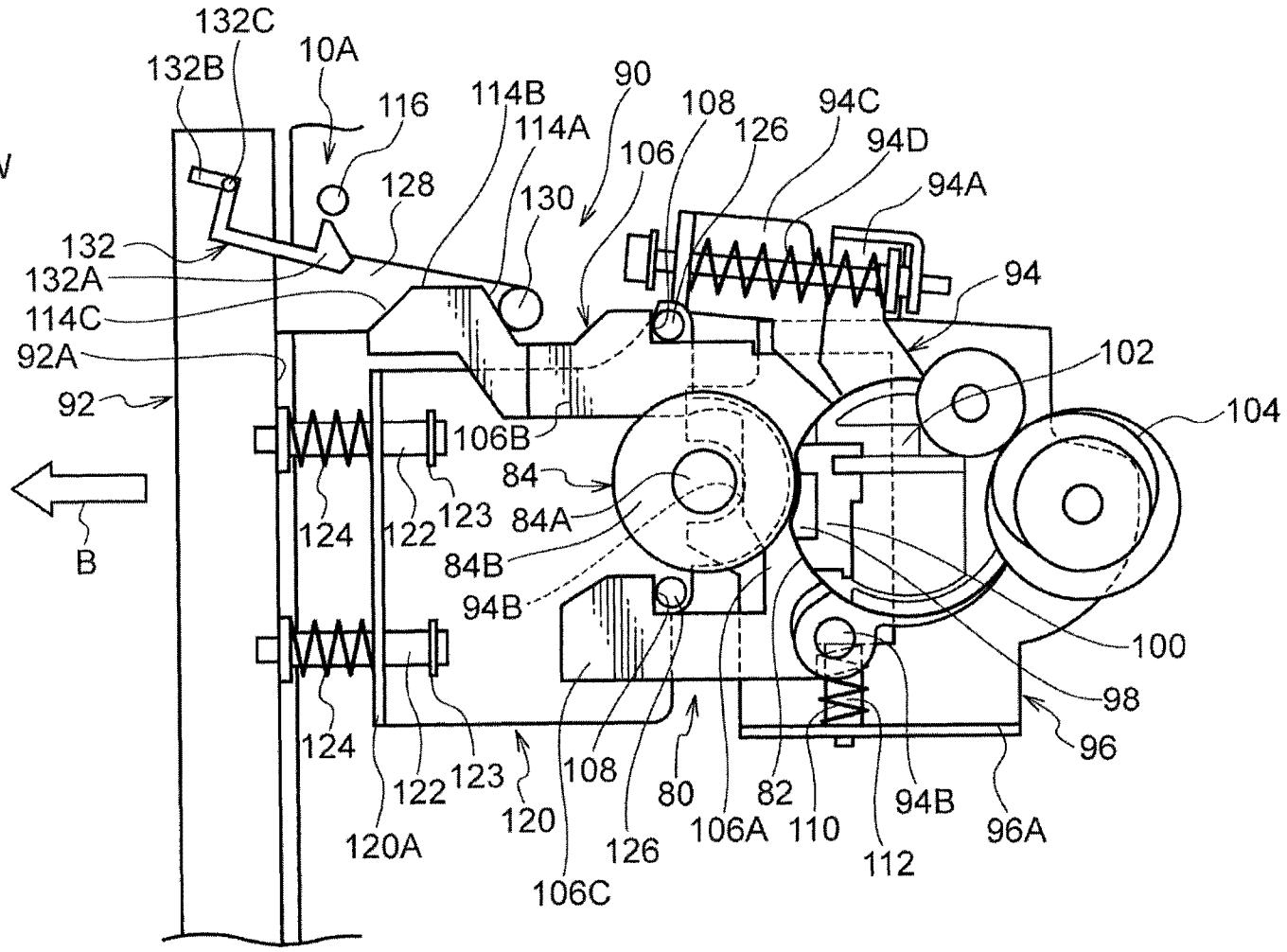
FIG. 3 is a diagram illustrating a configuration of the detachable device illustrated in FIG. 2 in a state shown during movement of the cover in a detachment direction from the apparatus main body.
Figure 4:
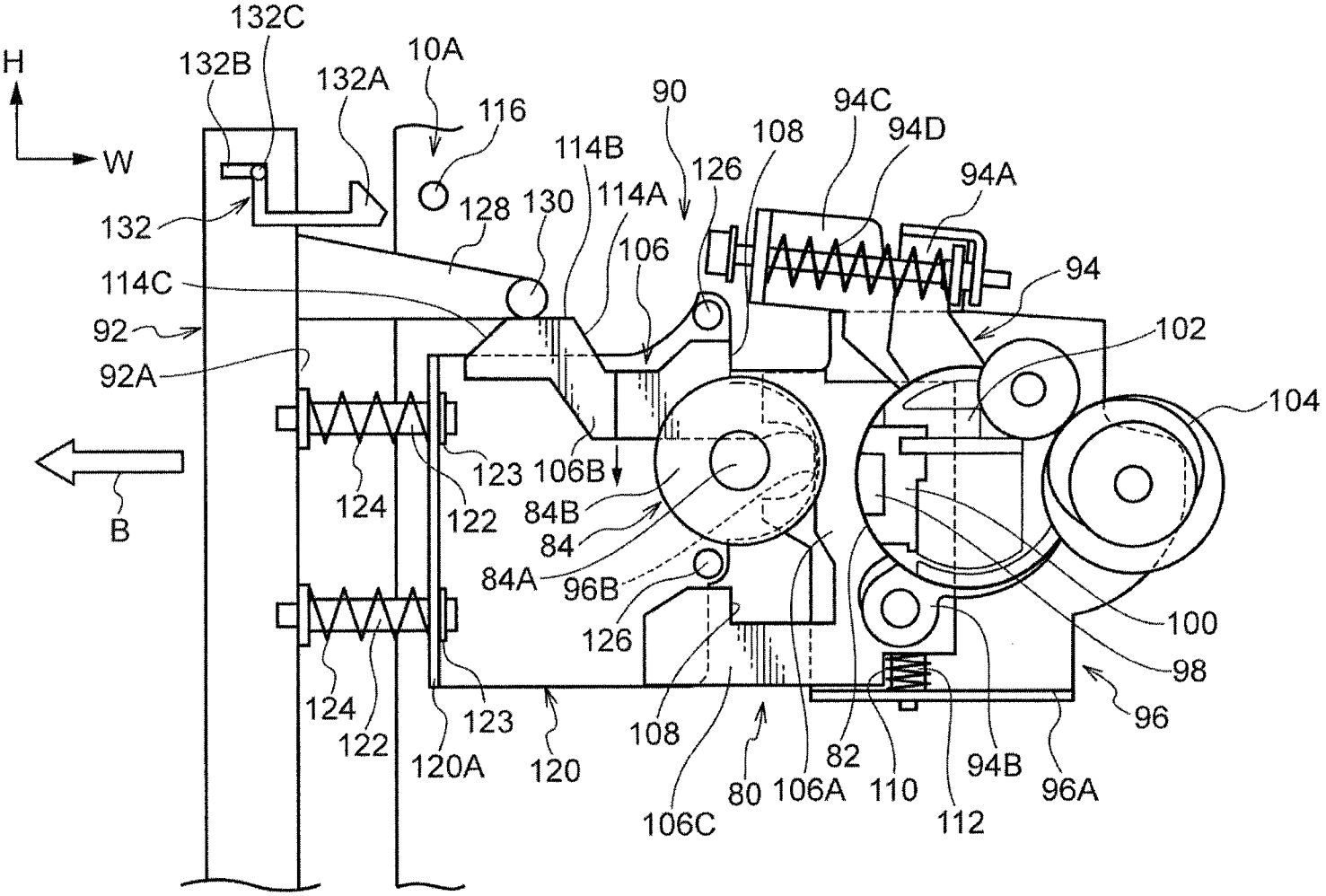
FIG. 4 is a diagram illustrating a configuration of the detachable device illustrated in FIG. 2 in a state shown during movement of the cover in the detachment direction from the apparatus main body and illustrating a state in which a pin is disengaged from a moving member.

As illustrated in FIG. 3, in this configuration, during the movement of the cover 92 in the direction (direction of arrow B) of detachment from the apparatus main body 10A, the float spring 124 elongates and thereby, the support member 120 does not follow the movement of the cover 92, but the support member 120 is held at an original position thereof. In this state, since the support member 120 does not move, the engagement of the upper pin 126 with the recess 108 of the upper hook 106B is maintained and the engagement of the lower pin 126 of the support member 120 with the recess 108 of the lower hook 106C is maintained. In other words, the support member 120 includes two pins 126, the elongation and contraction of the float spring 124 causes the cover 92 and the support member 120 to relatively move, and thereby relative movement between the cover 92 and the two pins 126 by a set distance in the attachment-detachment direction of the cover 92 is allowed. In other words, in the exemplary embodiment, an allowable structure is configured of the support member 120, the float pins 122 and the float springs 124, and allows the relative movement between the cover 92 and the two pins 126.

As illustrated in FIGS. 2 to 4, the detachable device 90 includes a pin 130 as an example of a release member that is provided in the cover 92 and causes the moving member 106 to move. More specifically, a projecting portion 128 extending to the apparatus main body 10A side is provided above (above the float pin 122) the inner wall 92A of the cover 92, and the pin 130 is fixed to a front end of the projecting portion 128. An axial direction of the pin 130 is a direction along the shaft 84A of the straightening roll 84.

A first inclined portion (tapered portion) 114A is provided on the upper wall of the upper hook 106B in the moving member 106 and is an example of an inclined portion disposed to have an upward grade in a direction of approach to the cover 92. The first inclined portion 114A is provided on the cover 92 side from the recess 108 in the longitudinal direction of the upper hook 106B. Further, a top portion 114B is provided on the upper wall of the upper hook 106B at a position which is adjacent to an end portion of the first inclined portion 114A on the cover 92 side and has the highest height in the vertical direction. The top portion 114B is formed of a flat surface.

The pin 130 slides on the first inclined portion 114A and the top portion 114B of the upper hook 106B in response to a detachment operation of the cover 92 from the apparatus main body 10A, and thereby the moving member 106 is pushed by the pin 130 so as to move downward against the force of the spring 110 (refer to FIG. 4). The downward movement of the moving member 106 causes the upper pin 126 to be disengaged from the recess 108 of the upper hook 106B and causes the lower pin 126 of the support member 120 to be disengaged from the recess 108 of the lower hook 106C. In other words, the moving member 106 moves to a position at which the moving member does not hold the cover 92. In this manner, the cover 92 is caused to move in a direction (direction of the arrow B) of the detachment from the apparatus main body 10A such that the straightening roll 84 and the straightening belt 82 are released from the press-contact.

In addition, a second inclined portion 114C is provided on the upper wall of the upper hook 106B in the moving member 106 at a position adjacent to the top portion 114B and is disposed to have a downward grade in a direction of approach to cover 92. The second inclined portion 114C is disposed on the front end side (cover 92 side) from the first inclined portion 114A and the top portion 114B in the longitudinal direction of the upper hook 106B. The pin 130 slides on the second inclined portion 114C of the upper hook 106B in response to an attachment operation of the cover 92 to the apparatus main body 10A, and thereby the moving member 106 is pushed by the pin 130 so as to move downward against the force of the spring 110 (refer to FIG. 6).

A hook 132 is provided in the upper portion (upper side from the float pin 122) of the cover 92 and has an L-shaped locking portion 132A. A pin 116, to which the locking portion 132A of the hook 132 is locked, is provided in the apparatus main body 10A. The hook 132 has an operating lever 132B that is exposed on the front side of the cover 92 on a side opposite to the locking portion 132A. The hook 132 may rotate around a shaft 132C provided between the locking portion 132A and the operating lever 132B. The cover 92 is configured to move in a direction in which the locking portion 132A of the hook 132 and the pin 116 are released from the locking by an operation of the operating lever 132B. In addition, the hook 132 is held at the position at which the locking portion 132A is locked with the pin 116 by a force of the float spring 124, and is held (locked) at the position at which the cover 92 is attached to the apparatus main body 10A.

Operation and Effect

Next, operations and effects of the exemplary embodiment will be described.

As illustrated in FIG. 2, in the state in which the cover 92 is attached to the apparatus main body 10A (the state of closing by the cover 92), the moving member 106 provided in the apparatus main body 10A is caused to move to the position, at which the moving member 106 holds the cover 92, by the force of the spring 110. In other words, the upper pin 126 provided in the support member 120 of the cover 92 engages with the recess 108 of the upper hook 106B of the moving member 106 and the lower pin 126 provided in the support member 120 of the cover 92 engages with the recess 108 of the lower hook 106C of the moving member 106. In this manner, the cover 92 is held at the attachment position of the cover to the apparatus main body 10A, and the nip pressure (press-contact load) is maintained between the straightening belt 82 provided in the apparatus main body 10A and the straightening roll 84 provided in the cover 92.

As illustrated in FIG. 3, when the cover 92 is detached from the apparatus main body 10A, the cover 92 is caused to move in a direction (direction of the arrow B) of being separated from the apparatus main body 10A. At this time, the operation of the operating lever 132B of the hook 132, which is exposed on the front side of the cover 92, causes the locking portion 132A of the hook 132 and the pin 116 of the apparatus main body 10A to be released from the locking.

During the movement of the cover 92 in the direction (direction of the arrow B) of detachment from the apparatus main body 10A, the float spring 124 elongates and thereby, the support member 120 does not follow the movement of the cover 92, but the support member 120 is held at the original position thereof. Therefore, the engagement of the upper pin 126 with the recess 108 of the upper hook 106B is maintained and the engagement of the lower pin 126 of the support member 120 with the recess 108 of the lower hook 106C is maintained. In other words, the float spring 124 elongates and the support member 120 is held at the original position, thereby the relative movement between the cover 92 and the two pins 126 and 126 is permitted in the set distance in the detachment direction of the cover 92. Hence, until the cover 92 moves by the set distance from the apparatus main body 10A in the detachment direction, the engagement of the upper pin 126 with the recess 108 of the upper hook 106B and the engagement of the lower pin 126 with the recess 108 of the lower hook 106C are maintained.

When the cover 92 is caused to move in the direction (direction of the arrow B) of the detachment from the apparatus main body 10A, the pin 130 of the cover 92 slides on the first inclined portion 114A and the top portion 114B of the upper hook 106B of the moving member 106 in response to the detachment operation of the cover 92 from the apparatus main body 10A. In this manner, the moving member 106 is pushed by the pin 130 of the cover 92 so as to move downward against the force of the spring 110. As illustrated in FIG. 4, in the state in which the pin 130 of the cover 92 contacts with the top portion 114B of the upper hook 106B, the upper pin 126 is disengaged from the recess 108 of the upper hook 106B and the lower pin 126 of the support member 120 is disengaged from the recess 108 of the lower hook 106C. In other words, since the moving member 106 moves to the position at which the moving member does not hold the cover 92, the straightening roll 84 and the straightening belt 82 are released from the press-contact. In addition, the float spring 124 elongates in response to the detachment operation of the cover 92, thereby, an amount of floating of the support member 120 with respect to the float pin 122 is reduced, and the support member 120 moves to the position at which the support member contacts with the stopper 123 of the float pin 122 (the amount of the floating of the support member 120 is zero). In this manner, the support member 120 is connected with the cover 92 and moves in the detachment direction (direction of the arrow B).

Figure 5:
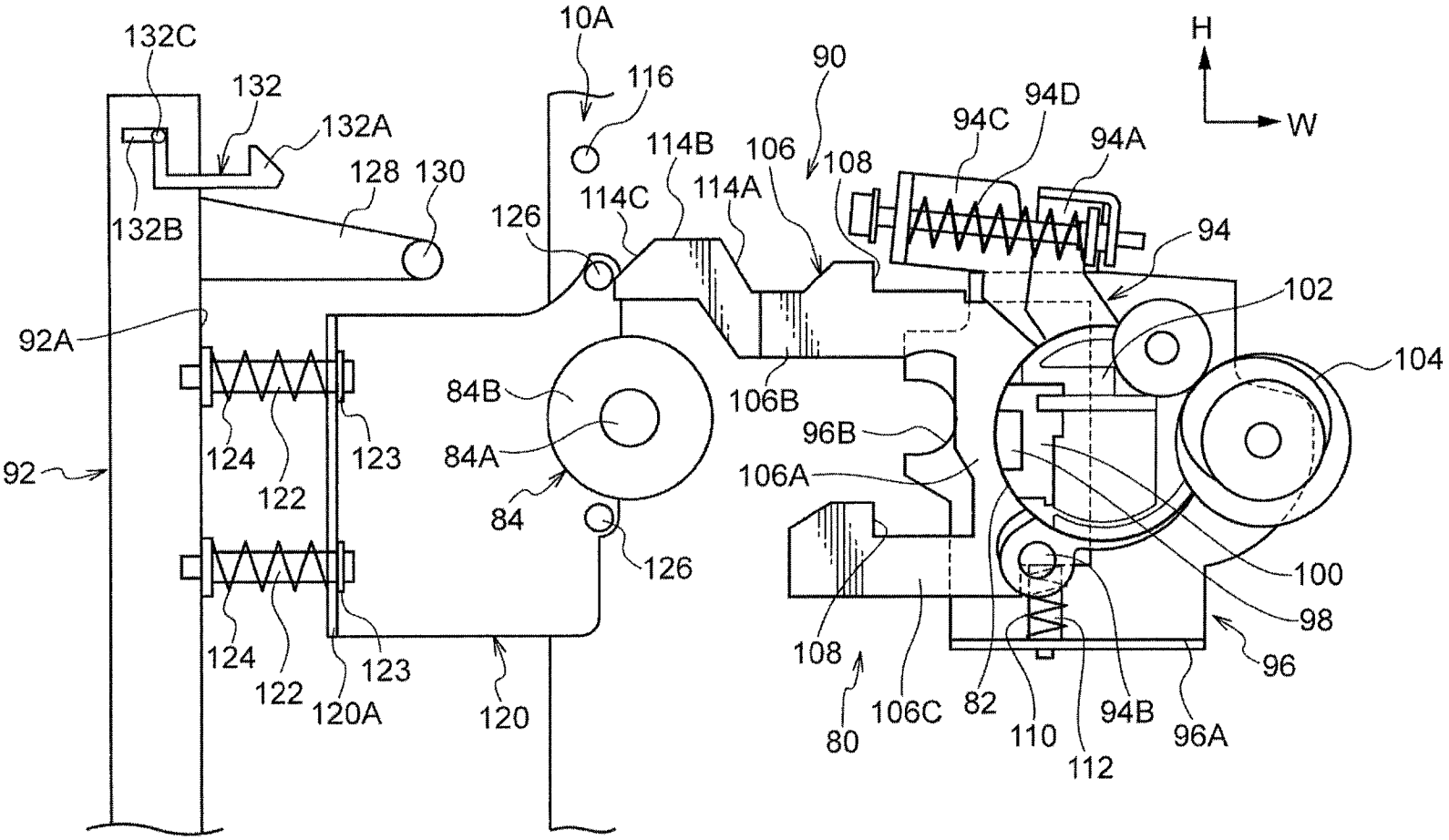
FIG. 5 is a diagram illustrating a configuration of the detachable device illustrated in FIG. 2 in a state in which the cover is completely moved in the detachment direction from the apparatus main body.

The cover 92 is caused to further move in the direction (direction of the arrow B) of detachment from the apparatus main body 10A, and thereby, as illustrated in FIG. 5, the cover 92 enters a state of being detached from the apparatus main body 10A (the state of opening by the cover 92). During the detachment of the cover 92 from the apparatus main body 10A, the upper pin 126 of the cover 92 is separated from the upper hook 106B, and thereby the force of the spring 110 causes the moving member 106 to move upward. Note that, when the moving member 106 moves upward, a stopper (not illustrated), which the moving member 106 touches, is provided in the holding member 96.

In the detachable device 90 having the above configuration, in the state in which the moving member 106 moves to the position on the upper side at which the moving member holds the cover 92, the nip pressure (press-contact load) is maintained between the straightening belt 82 and the straightening roll 84. In addition, in the state in which the pin 130 of the cover 92 causes the moving member 106 to move to the position on the lower side at which the moving member does not hold the cover 92, the straightening belt 82 and the straightening roll 84 are released from the press-contact. Therefore, functions of a maintaining operation of the press-contact load between the straightening belt 82 and the straightening roll 84 and a nip-releasing operation between the straightening belt 82 and the straightening roll 84.

Figure 6:
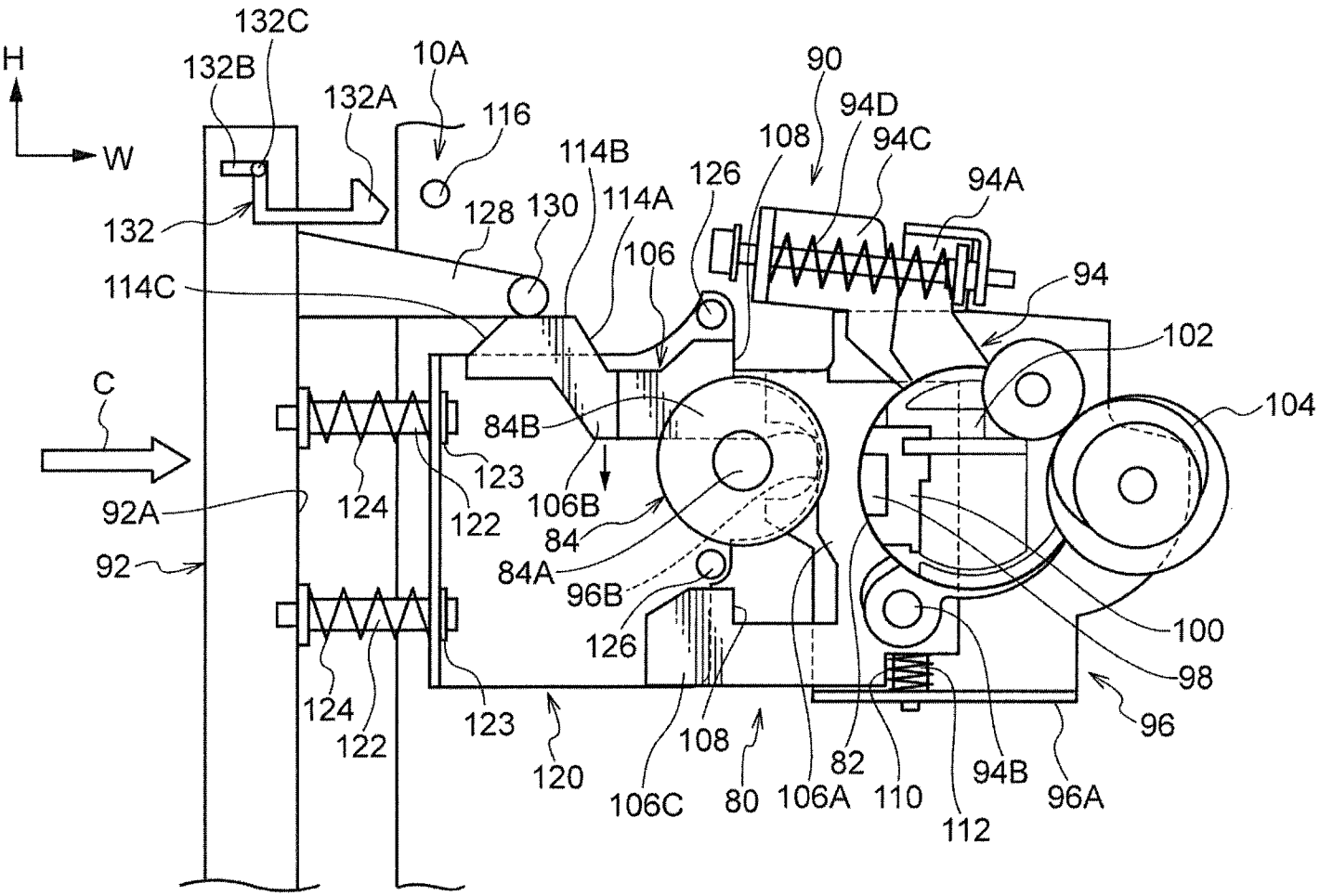
FIG. 6 is a diagram illustrating a configuration of the detachable device illustrated in FIG. 5 in a state shown during attachment of the cover to the apparatus main body and illustrating a state in which the moving member is pushed down.

Meanwhile, when the cover 92 is attached to the apparatus main body 10A from the detachment state of the cover 92 illustrated in FIG. 5, the cover 92 is caused to move to the apparatus main body 10A side (refer to a direction of arrow C illustrated in FIG. 6). The pin 130 of the cover 92 slides on the second inclined portion 114C and the top portion 114B of the upper hook 106B of the moving member 106 in response to the attachment operation of the cover 92 to the apparatus main body 10A. In this manner, as illustrated in FIG. 6, the moving member 106 is pushed by the pin 130 so as to move downward against the force of the spring 110.

Further, when the cover 92 is caused to further move in the direction (direction of the arrow C) of the attachment to the apparatus main body 10A, the pin 130 of the cover 92 moves in the direction of the arrow C, thereby, the pin 130 slides on the first inclined portion 114A of the upper hook 106B such that the moving member 106 is caused to move upward by the force of the spring 110. Then, the shaft 84A of the straightening roll 84 is inserted into the recessed portion 96B of the holding member 96 provided in the apparatus main body 10A such that the float spring 124 is contracted, and thereby the cover 92 relatively moves to the direction of approach to the support member 120.

Figure 7:
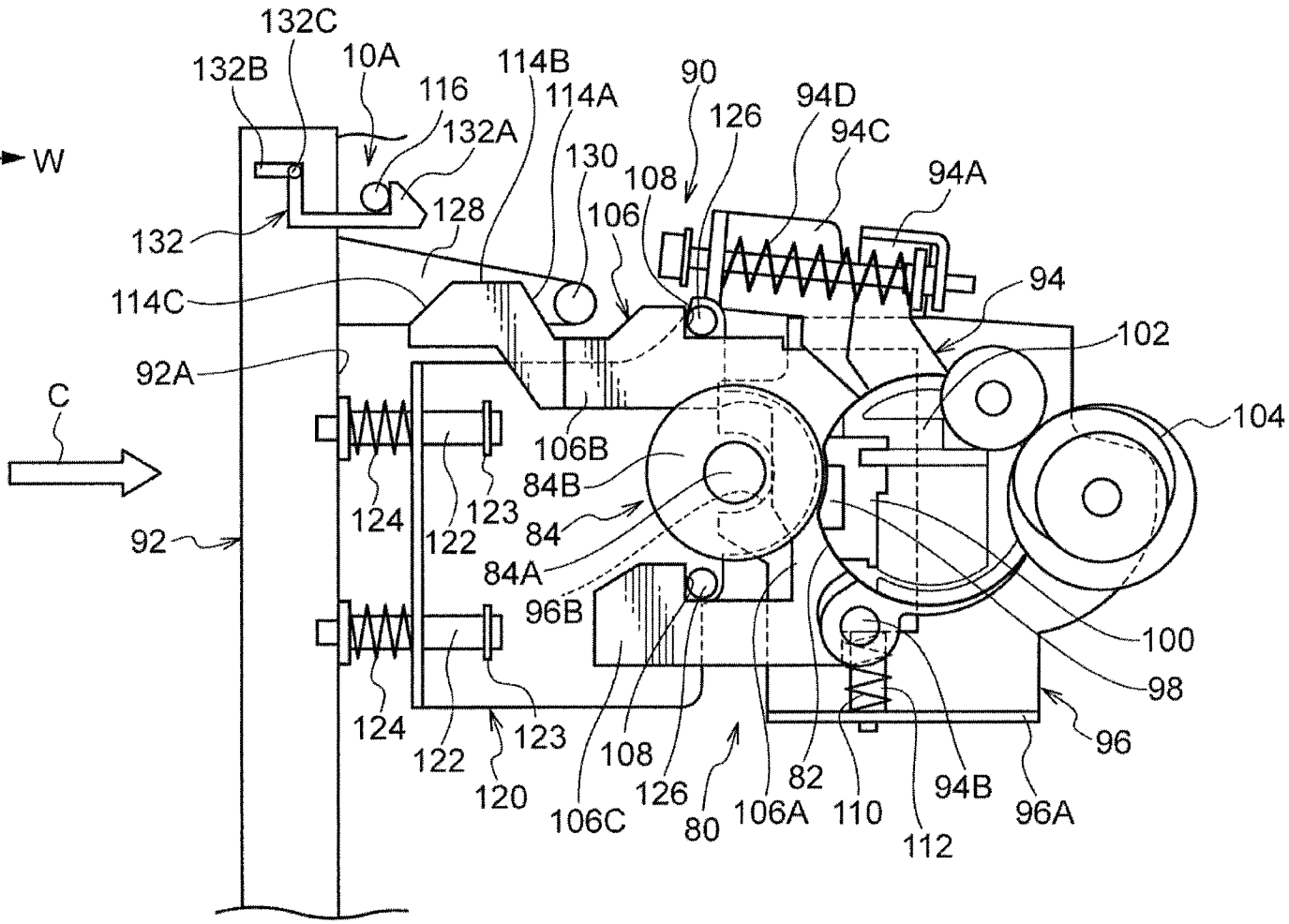
FIG. 7 is a diagram illustrating a configuration of the detachable device illustrated in FIG. 5 in a state in which the cover is attached to the apparatus main body.

As illustrated in FIG. 7, when the cover 92 is caused to further move in the direction (direction of the arrow C) of the attachment to the apparatus main body 10A, the moving member 106 is caused to move upward by the force of the spring 110. Accordingly, the upper pin 126 provided in the support member 120 of the cover 92 engages with the recess 108 of the upper hook 106B of the moving member 106, and the lower pin 126 provided in the support member 120 of the cover 92 engages with the recess 108 of the lower hook 106C of the moving member 106. In this manner, the moving member 106 holds the cover 92 at the attachment position of the apparatus main body 10A such that the nip pressure (press-contact load) is maintained between the straightening belt 82 provided in the apparatus main body 10A and the straightening roll 84 provided in the cover 92.

In the detachable device 90 having the above configuration, the cover 92 is less locked to the apparatus main body 10A when the straightening belt 82 and the straightening roll 84 are released from the press-contact, compared to a configuration in which the detachable member hold the press-contact load.

In addition, in the detachable device 90, it is possible to move the moving member 106 with a small operating force, compared to a configuration in which the moving member moves in the detachment direction of the detachable member from the apparatus main body.

In addition, in the detachable device 90, it is possible to delay a timing of a start of the detachment of the cover 92 or a start of the movement of the moving member 106, compared to a configuration in which the detachable member does not have the engagement portion that holds the movement member and the allowable structure that allows the relative movement of the engagement portion.

In addition, in the detachable device 90, it is possible for the moving member 106 to move with a simple structure in a direction different from the attachment-detachment direction of the cover 92, compared to a case where a configuration, in which the moving member is caused to move by the sliding of the release member on the inclined portion of the moving member, is not employed.

Further, in the image forming apparatus 10, when the straightening belt 82 and the straightening roll 84 which are provided in the curl removing device 80 are released from the press-contact, the cover 92 is less locked to the apparatus main body 10A, compared to a configuration in which the detachable device 90 is not provided in the curl removing device.

In addition, in the exemplary embodiment described above, the detachable device 90 has the configuration in which the straightening belt 82 and the straightening roll 84, which are provided in the curl removing device 80, come into press-contact with and are detached from each other; however, the invention is not limited to this configuration. For example, the detachable device 90 may have a configuration in which the heating belt 24A and the pressure roll 24B, which are provided in the fixing device 24, come into press-contact with and are detached from each other. In addition, for example, the detachable device 90 may have a configuration in which the assist roll 50 and the secondary transfer roll 22, which are provided at a secondary transfer position, come into press-contact with and are detached from each other.

In addition, the specific exemplary embodiment of the invention is described in detail; however, the invention is not limited to the exemplary embodiment, and it is obvious to those skilled in the art that other various exemplary embodiments may be configured within the scope of the invention.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A detachable device comprising:

a cover that is provided to be attachable to and detachable from an apparatus main body in which a first rotating member is provided;

a support member that supports a second rotating member which is brought into press-contact with the first rotating member;

a float pin that connects the cover with the support member and that allows a movement of the support member relative to the cover in an attachment-detachment direction of the cover;

a moving member that is provided in the apparatus main body, that holds the cover at an attachment position to the apparatus main body so as to maintain a press-contact load between the first rotating member and the second rotating member, and that is movable to a position at which the cover is not held by the moving member; and a release member that is provided in the cover, and that causes the moving member to move to the position at which the cover is not held by the moving member in response to a detachment operation of the cover from the apparatus main body such that the first rotating member and the second rotating member are released from the press-contact therebetween.

2. The detachable device according to claim 1, wherein the moving member is configured to move in a direction intersecting with an attachment-detachment direction of the cover with respect to the apparatus main body.

3. The detachable device according to claim 2, wherein the support member has an engagement portion that engages with the moving member and is held by the moving member.

4. The detachable device according to claim 3, further comprising:

a bias member that biases the moving member to a position at which the cover is held by the moving member, wherein the release member is configured to slide on an inclined portion provided on the moving member and thereby, to cause the moving member to move, against the bias member, to a position at which the cover is not held by the moving member.

5. The detachable device according to claim 2, further comprising:

a bias member that biases the moving member to a position at which the cover is held by the moving member, wherein the release member is configured to slide an inclined portion provided on the moving member and thereby, to cause the moving member to move, against a force by the bias member, to a position at which the cover is not held by the moving member.

6. The detachable device according to claim 1, wherein the support member has an engagement portion that engages with the moving member and is held by the moving member.

7. The detachable device according to claim 6, further comprising:

a bias member that biases the moving member to a position at which the cover is held by the moving member, wherein the release member is configured to slide an inclined portion provided on the moving member and thereby, to cause the moving member to move, against a force by the bias member, to a position at which the cover is not held by the moving member.

8. The detachable device according to claim 1, further comprising:

a bias member that biases the moving member to a position at which the cover is held by the moving member, wherein the release member is configured to slide an inclined portion provided on the moving member and thereby, to cause the moving member to move, against a force by the bias member, to a position at which the cover is not held by the moving member.

9. An image forming apparatus comprising:

a curl removing device disposed at a downstream side of a fixing device in a transporting direction of a recording medium; and the detachable device according to claim 1 having a configuration by which the first rotating member and the second rotating member, which are provided in the curl removing device, are brought into press-contact with or are detached from each other.

* * * * *